US005730316A

United States Patent [19]

Falk

[11] Patent Number: 5,730,316

[45] Date of Patent: Mar. 24, 1998

[54] MULTIPLE-PRODUCT MERCHANDISING MACHINE

[75] Inventor: Leonard P. Falk, Chesterfield, Mo.

[73] Assignee: Crane Company, Stamford, Conn.

[21] Appl. No.: 490,799

[22] Filed: Jun. 15, 1995

[51] Int. Cl.[6] ..... G07F 11/06

[52] U.S. Cl. ..... 221/122; 221/12; 221/91; 221/89; 221/153

[58] Field of Search ..... 221/89, 91, 121, 221/122, 153, 12; 312/109, 138.1, 405, 139.2

[56] References Cited

U.S. PATENT DOCUMENTS

| | | | |
|---|---|---|---|
| 2,696,417 | 12/1954 | Jouk | 312/223 |
| 2,697,536 | 12/1954 | Cicero | 220/30 |
| 2,895,779 | 7/1959 | Bender | 312/138 |
| 2,994,572 | 8/1961 | Morrison | 312/116 |
| 3,122,401 | 2/1964 | Johnson | 221/12 |
| 3,357,133 | 12/1967 | Helsing | 49/25 |
| 3,659,745 | 5/1972 | Striegl et al. | 221/12 |
| 3,684,131 | 8/1972 | Kurimsky | 221/242 |
| 3,901,366 | 8/1975 | Schuller et al. | 194/4 C |
| 4,251,009 | 2/1981 | McLaughlin et al. | 221/12 |
| 4,391,388 | 7/1983 | Krakauer | 221/76 |
| 4,842,349 | 6/1989 | Stenemann | 312/116 |
| 4,927,051 | 5/1990 | Falk et al. | 221/12 |
| 4,944,391 | 7/1990 | Johnson | 221/91 |
| 4,981,275 | 1/1991 | Sheu | 248/147 |
| 5,048,717 | 9/1991 | Falk et al. | 221/12 |
| 5,501,364 | 3/1996 | Cooper | 221/12 |
| 5,511,646 | 4/1996 | Maldanis | 221/12 |

FOREIGN PATENT DOCUMENTS

| | | | |
|---|---|---|---|
| 85591 | 9/1988 | Italy . | |
| 3-276388 | 12/1991 | Japan | 221/12 |

*Primary Examiner*—William E. Terrell
*Assistant Examiner*—Khoi H. Tran
*Attorney, Agent, or Firm*—Senniger, Powers, Leavitt & Roedel

[57] ABSTRACT

A multiple product merchandising machine having a cylindrical drum mounted within a cabinet and having a plurality of compartments of varying size which pass by at least one access door. The access door is mounted in the cabinet for sliding movement to allow access to a compartment aligned with the access door. The door is motorized so that it will open and close automatically once activated by slight movement of its handle. The size of the compartment aligned with the door when it is opened is known by the control circuit and the motor moves the door only far enough to allow access by a customer to that compartment.

20 Claims, 9 Drawing Sheets

MULTIPLE-PRODUCT MERCHANDISING MACHINE

BACKGROUND OF THE INVENTION

The present invention relates to multiple-product merchandising machines and more particularly to such machines which dispense many different kinds and sizes of products from a plurality of separate compartments mounted for movement past one or more product access doors. The machine is configured to dispense a chosen product to a customer through an access door into the machine.

Such machines are generally shown, for example, in U.S. Pat. No. 4,927,051. The product compartments in such machines are formed by a series of vertically spaced circular shelves and movable partitions extending between the shelves so that the spaces between the shelves are divided into a plurality of pie-shaped compartments. These compartments can be rotated past an associated transparent access door for each shelf level so that a customer can make a product selection by viewing the products through the door as they pass. After an appropriate amount of currency has been inserted in the machine the access door is unlocked so that the customer can slide the door away from the opening and retrieve the selected product from the compartment aligned with the access door. The door is then closed by a spring and automatically locked so that the machine is available for the next customer selection.

One disadvantage associated with such prior art machines is that the access doors are automatically closed by a spring if the customer accidently lets go of the handle before he has time to remove his purchase. It also requires the use of two hands to retrieve the purchase from a compartment since one hand is needed to hold the door while the other is used to remove the purchase from the compartment.

Such prior art machines also generally allow reconfiguration of the size of the compartments by moving the partitions extending between the shelves so that the width of the compartments can be increased or decreased. In order to accommodate this versatility in compartment width, manually adjustable access door stops are provided to permit the size of the access openings to be matched to the widths of the compartments which pass them. The stop prevents the door from being opened beyond the width of the compartments. However, because the door stops are fixed at a specific position during machine use, the widths of the compartments on a given shelf must all be the same size. Thus, although such prior art machines permit the use of different priced items in different compartments on the same shelf, they do not allow the positioning of items larger than the chosen size of compartments to be vended from that shelf. This limits the versatility of such a machine since pricing variations are some what dependent on size, particularly in food vending machines.

SUMMARY OF THE INVENTION

The present invention overcomes the difficulties and disadvantages associated with the prior art machines as mentioned above and provides further additional features not available in such machines.

These objectives are accomplished by the provision of a multiple-product merchandising machine in which the product access doors are automatically opened and closed and in which the compartment widths can vary on a shelf during use since the opening width of the door is automatically adjusted to the width of the compartment aligned with the door when it is opened.

Some of the advantages of the present invention are provided by a multiple-product merchandising machine comprising a cabinet having at least one product access opening defined therein; at least one product access door associated with a respective product opening in the cabinet, the door being movable between an open position to permit access to the interior of the cabinet through the associated opening, and a closed position in which access to the interior of the cabinet through the opening is prevented; a plurality of product compartments of adjustable width mounted in the cabinet for movement past the at least one access door and accessible through the respective opening when the door is in the open position; currency actuated means for allowing a selected access door to be moved from the closed position to the open position when a predetermined amount of currency is inserted by a customer; means for opening any one of the at least one access doors to an open position corresponding to the width of a compartment aligned with the opening; and means for correlating the location of each compartment relative to the opening and controlling the opening means to adjust the open position of the door to the width of the compartment aligned with the opening.

Further advantages of the present invention are provided by such a multiple-product merchandising machine in which the means for opening the door includes means for closing the door after it has been opened for a predetermined time and by including means for sensing resistance to the closing movement of the door and causing the means for opening the door to reopen the door and thereafter again close the door.

Yet further advantages of the present invention are provided by a multiple-product merchandising machine comprising a cabinet having a plurality of product access openings defined therein; a plurality of product access doors each associated with a respective product opening in the cabinet, each door being movable between an open position to permit access to the interior of the cabinet through the associated opening, and a closed position in which access to the interior of the cabinet through the opening is prevented; a plurality of product compartments of adjustable width disposed in a plurality of groups, each group being mounted in the cabinet for movement past an associated access door and accessible through the respective opening when the door is in the open position; currency actuated means for allowing a selected access door to be moved from the closed position to the open position when a predetermined amount of currency is inserted by a customer; means for opening any one of the access doors to an open position corresponding to the width of a compartment aligned with the opening; and means for correlating the location of each compartment relative to its respective opening and controlling the opening means to adjust the open position of the door to the width of the compartment aligned with the opening.

Still further advantages of the present invention are provided by a multiple-product merchandising machine comprising a cabinet with a plurality of access openings defined therein; a plurality of product compartments disposed in a plurality of groups, each group being mounted in the cabinet for movement past an associated access opening, each compartment having an open side and mounted in the cabinet for movement of the open sides past the associated access opening so as to provide access thereto and means for adjusting the dimension of the open side in the direction of movement thereof of at least some of the compartments so that compartments having different dimensions of the open sides will move past the associated access opening; a vend door associated with each access opening and mounted to the cabinet for movement in the direction of movement of the compartments associated therewith between a closed position wherein it is covering the opening and an open position wherein it allows access to a compartment aligned with the access opening; drive means for moving a selected vend door between its open and closed positions; control means for causing the drive means to vary the open position of the selected door to match the dimension of the open side of a compartment aligned therewith; and currency actuated means for allowing a selected access door to be moved from the closed position to the open position when a predetermined amount of currency is inserted by a customer.

Further advantages of the present invention are provided by such a machine in which the means for opening any one of the doors includes means for closing the doors after they have been opened for a predetermined time and providing means for sensing resistance to the closing movement of a door and causing the means for opening the door to reopen the door and thereafter again close the door.

In a preferred form of the present invention the means for opening and closing the doors includes a rack gear engaging a respective door to cause movement of the door between its open and closed positions; a pinion gear mounted for rotation in driving engagement with the rack gear; a reversible motor for rotating the pinion gear; and means interconnecting the door and the rack gear so as to allow limited movement of the door relative to the rack gear when the door is in its closed position. It also includes means for sensing an attempt to open any one of the doors and means for determining if sufficient credit has been established to allow a purchase from the machine and to allow the door to be opened once the means for sensing door movement senses an attempt to open the door.

DETAILED DESCRIPTION OF THE PREFERRED EMBODIMENT

Figure 1:
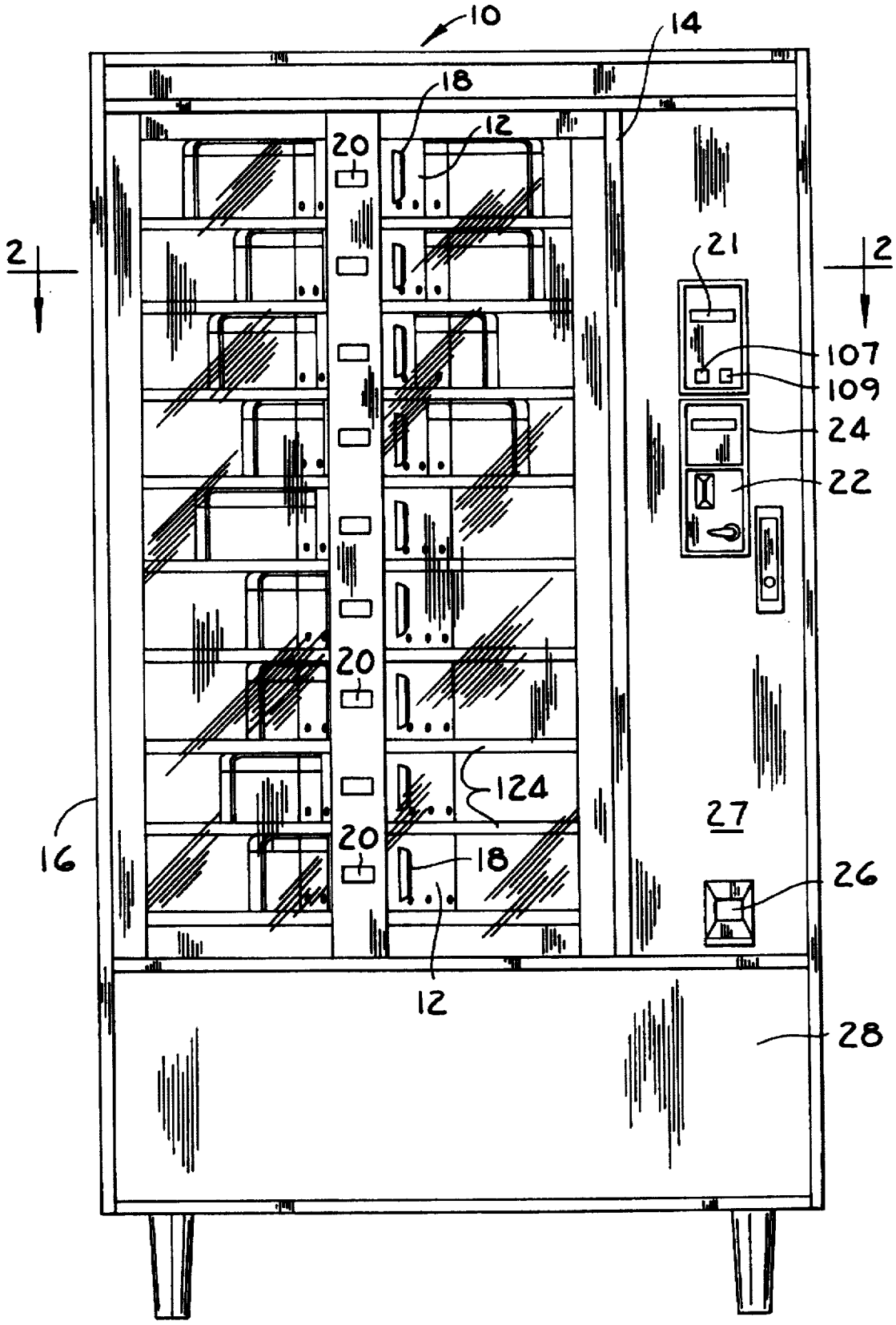
FIG. 1 is a front view of the preferred embodiment of the multiple-product merchandising machine of the present invention.

In a preferred embodiment of the multiple-product merchandising machine 10 of the present invention, as best seen in FIG. 1, a plurality of automatic transparent access doors 12 are mounted in the front service door 14 which forms most of the front of the cabinet 16 of the machine. The access doors 12 are in a common vertical plane and are mounted within the service door 14 for automatic horizontal movement between a closed, normally locked position, as they are shown in FIG. 1, and an open position which permits access to the interior of the cabinet 16. A handle 18, also transparent, is mounted to or formed in each access door 12 to permit each door to be manually moved slightly to the right, as viewed in FIG. 1, to initiate opening.

Adjacent each door 12 is a price display 20 which indicates the price of the product which can be purchased and removed from the adjacent door. The price displays are electronic, such as LED, LCD or similar electronic form so they can be easily changed from a control panel mounted within the machine as is discussed in more detail in U.S. Pat. No. 4,927,051, incorporated herein by reference. A similar electronic display 21 for credit and other messages is mounted on the service door 14.

Figure 2:
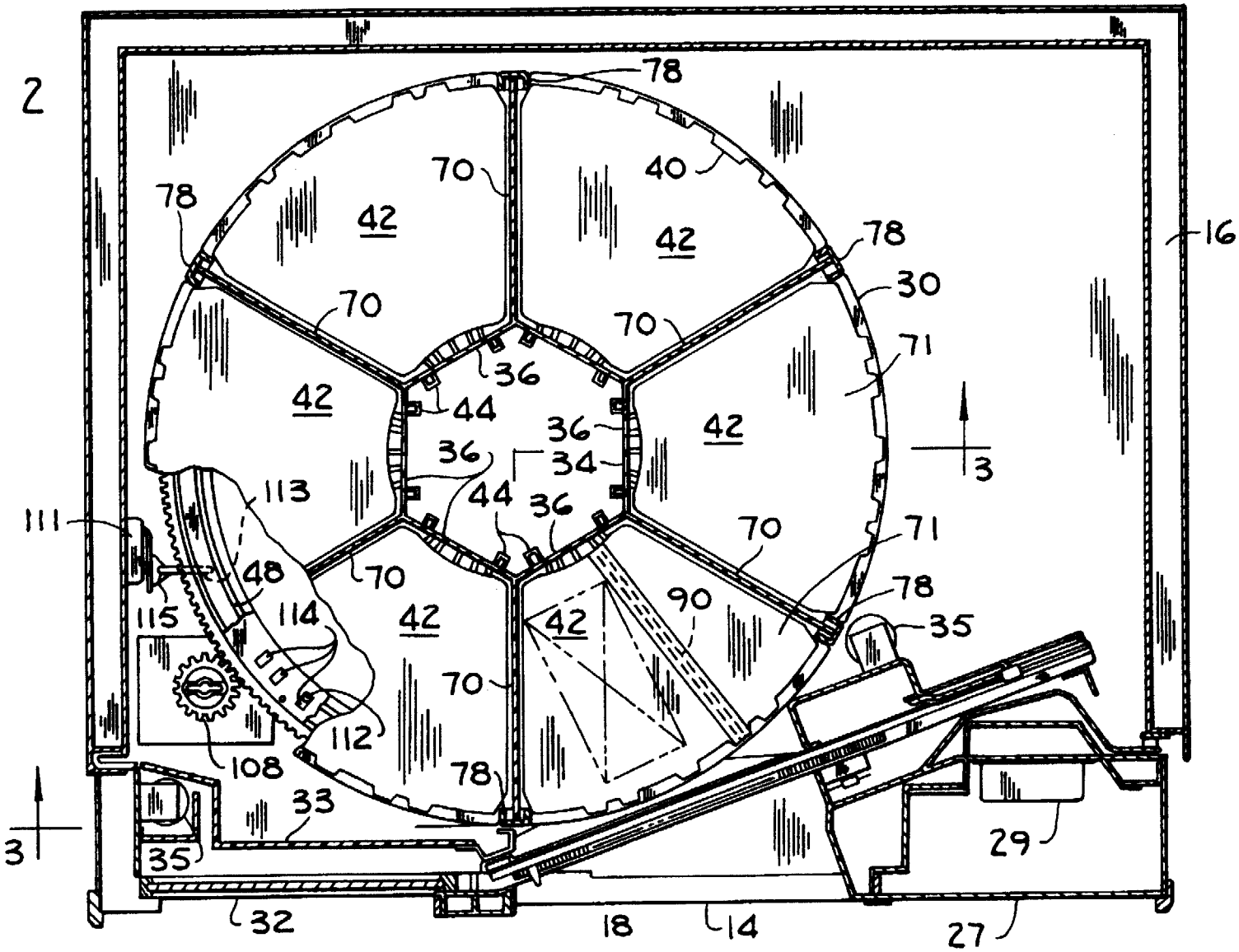
FIG. 2 is a top sectional view along the line 2—2 of FIG. 1.

Also mounted in the service door 14 are coin and bill receiving and validating mechanisms 22 and 24, respectively, and a coin return receptacle 26, all of a form well known in the art. The service door 14 is hinged on the left of the cabinet 16, as viewed in FIG. 2. A monetary door 27 is mounted within and forms part of the service door 14 and is also hinged on its left edge. The monetary door 27 covers the coin mechanism 22 and bill validator 24 which are contained within the space in the service door behind the monetary door 27, as seen in FIG. 2. Also contained in this area behind the monetary door is the control panel 29 used to set various functions of the machine including prices and discounts. A front skirt 28 forms the lower part of the service door 14 and covers an area of the cabinet beneath the access doors 12 which houses refrigeration equipment, etc.

As best seen in FIG. 2, mounted within the cabinet 16 for rotation is a cylindrical merchandise carrying drum 30 disposed behind the access doors 12 and a glass plate 32 forming an additional product viewing area behind which is a transparent plastic air deflection and insulation sheet 33. Fluorescent lights 35 are disposed on the service door 14 on each side of the viewing area to assist a customer in viewing the products.

The drum 30 is composed of a hexagonal sheet metal center column 34 which extends the full height of the drum. Each panel 36 which forms a side of the drum 30 has two rectangular holes 38 formed therein at the level of each of the annular shelves 40. Each shelf 40 is composed of six identical transparent plastic trays 42, each of which has tabs 44 which are received in the respective holes 38 and rest on the lower edge thereof to position the trays around the column 34. Bolted or otherwise secured to the top of the column is a sheet metal top disk (not shown) with a diameter approximately the same as the diameter of the annular shelves 40.

The bottom of the column 34 is fastened to a sheet metal base disk 46, approximately the diameter of the annular shelves 40, which in turn has bolted thereto a plastic ring gear 48 with a diameter also approximately the diameter of the shelves 40. A sheet metal ring 50 with an L-shaped cross section is fastened to the bottom of disk 46 and has a diameter less than the diameter of the ring gear 48. The ring 50 supports a plurality of rollers 52 on pins 54 mounted on the ring 50. The rollers 52 ride on the upper surface of a sheet metal floor plate 56 which forms a floor to the merchandise containing area of the machine 10, to support the drum 30 for rotation.

Figure 3:
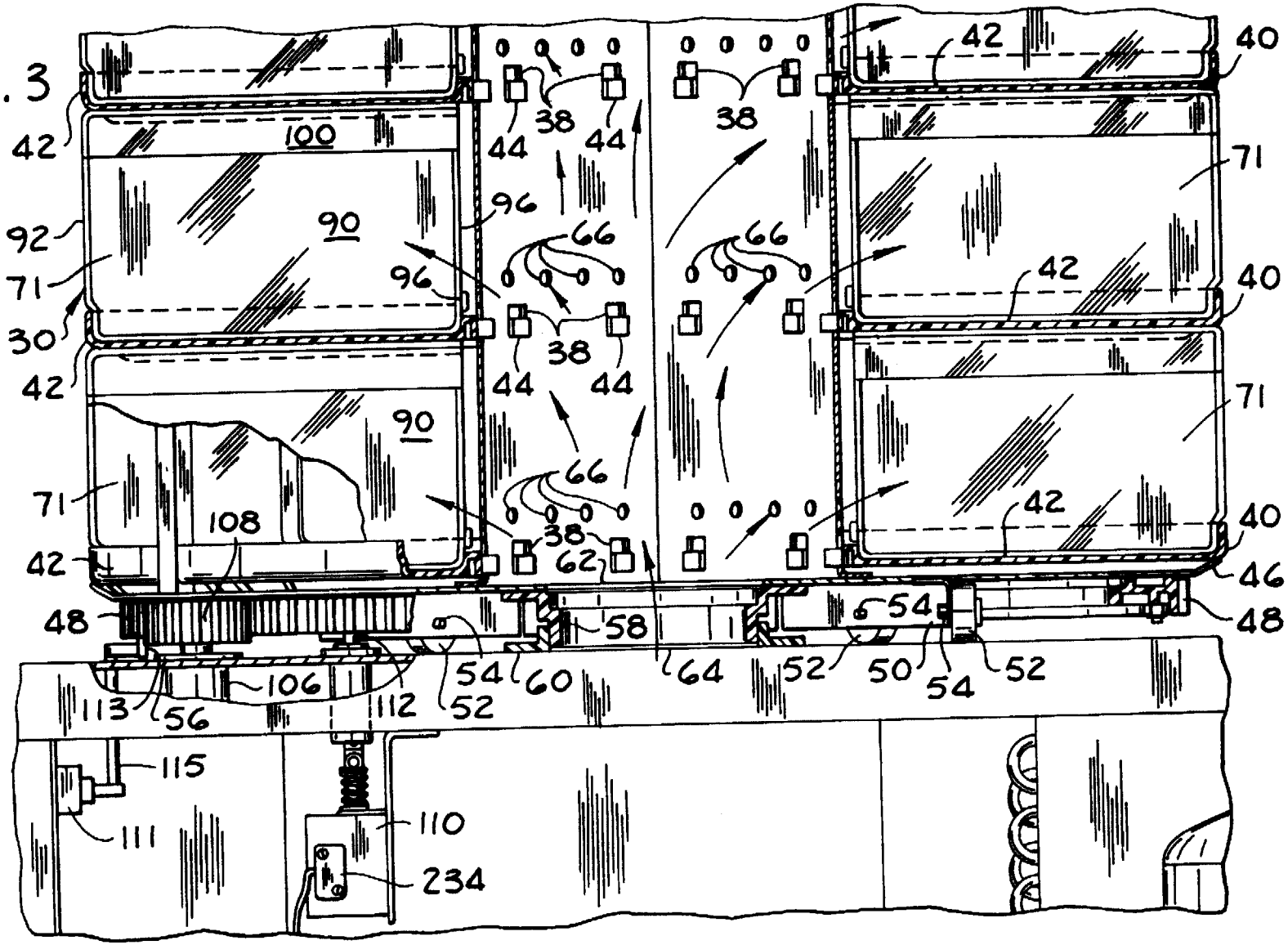
FIG. 3 is an enlarged partial sectional view along the line 3—3 of FIG. 2.

An annular plastic sleeve 58 is secured to the lower surface of base disk 46 and is matingly received in annular sleeve 60 secured to the floor plate 56. Both the base disk 46 and floor plate 56 have corresponding circular holes 62 and 64, respectively, which together with the sleeves 58 and 60 allow air to flow from the lower portion of the cabinet into the center column 34. Air handling and refrigeration equipment (not shown) contained in the lower portion of the cabinet is used to force cold air in the center column 34 through the sleeves 58 and 60 where it is then distributed uniformly over the products on the shelves 40 by passing through the plurality of holes 66 formed in each of the panels 36, as shown by the arrows in FIG. 3.

Also forming part of the merchandise carrying drum 30 are a plurality of walls 70, which in the preferred embodiment number six. Each of these walls 70 extend for the full height of the drum and are secured at their upper and lower ends to the top disk and base disk 46, respectively, of the drum 30 for rotation therewith. The walls 70 are preferably plastic and adjacent ones are alternately transparent and opaque for reasons discussed in U.S. Pat. No. 4,927,051, not relevant here, or can be all transparent if desired. Trays 42 extend between adjacent walls 70 to form with the walls a plurality of compartments 71 around each shelf 40.

Figure 5A:
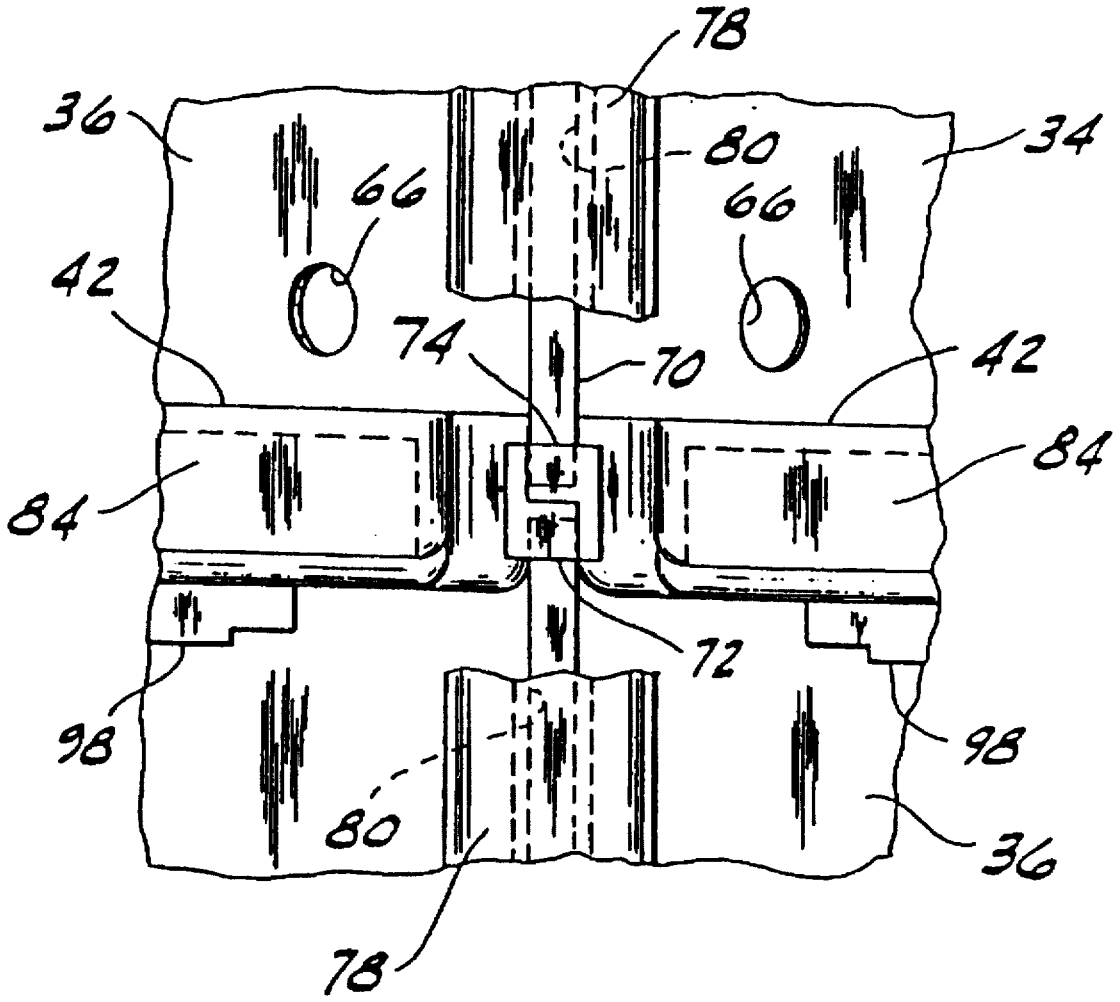
FIG. 5A is a view similar to FIG. 5 with a portion of the locking strip cut away to show the tabs on the sides of the trays.
Figure 5:
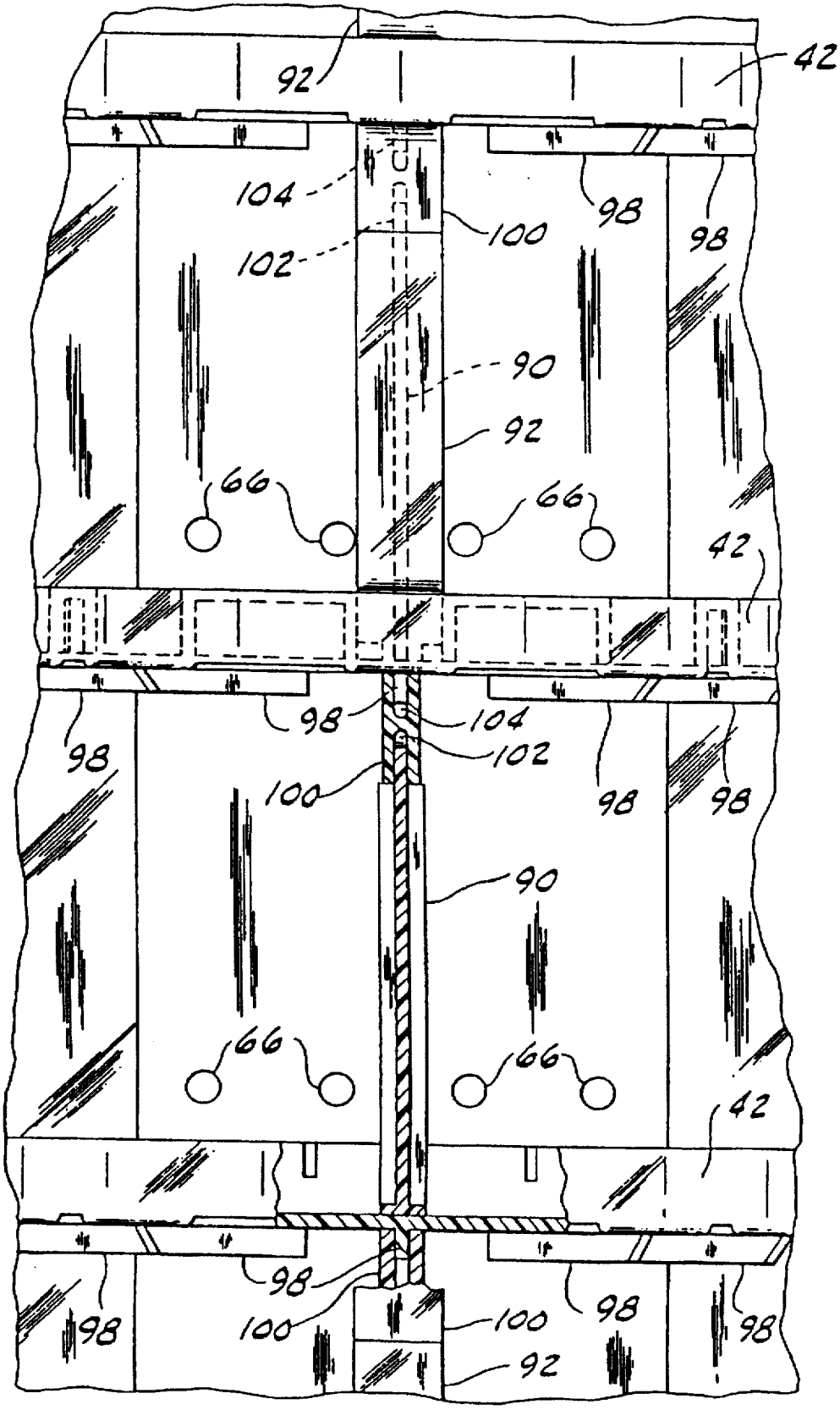
FIG. 5 is an enlarged partial front view of two shelves of the drum of the preferred embodiment.

The trays 42 each have tabs 72 and 74 on opposite outer edges of each as shown in FIG. 5 and FIG. 5A. Tab 72 is formed on the lower edge of the tray while tab 74 is formed on the upper opposite edge of the tray so that two adjacent trays can have their tabs nest with one another when they are positioned in the drum 30. The lower tab 72 of each tray 42 rests on the bottom surface of a rectangular notch 76 cut in the walls 70 at the proper places for locating the trays 42 to form the shelves 40. Once all of the trays are positioned in the notches 76 between adjacent walls 70 a channel-shaped vertical locking strip 78, preferably formed of a metal extrusion, is fixed at the ends of the adjacent walls 70 to prevent the tabs 72 and 74 from being removed from the notches 76 and thus locking the trays 42 in place. Formed as part of the strip 78 is a groove 80 which receives the edge of the wall 70 and helps rigidify it. The strip is preferably bolted at its upper and lower ends to the top disk and bottom disk of the drum 30.

Each of the trays 42 is generally dish-shaped with short side walls and can be further subdivided into smaller compartments 71. In each tray 42 there are provided a series of vertical channels 82 formed in the outer vertical edge wall 84 and facing the center column 34. In the preferred embodiment there are preferably five such channels which allow the tray to be divided in half, in thirds or in quarters. On the inner wall 86 of each tray are formed a series of grooves 88 which are aligned with the channels 82. Partitioning walls 90 are formed to be received in the channels 82 and grooves 88 to divide the trays as desired. The outer vertical edge 92 of each partitioning wall 90 is a wide flange which is matingly received in the channels 82. The inner vertical edge 94 of each partitioning wall 90 has a tab 96 extending from the lower portion thereof which is received in the notches 88.

Figure 4:
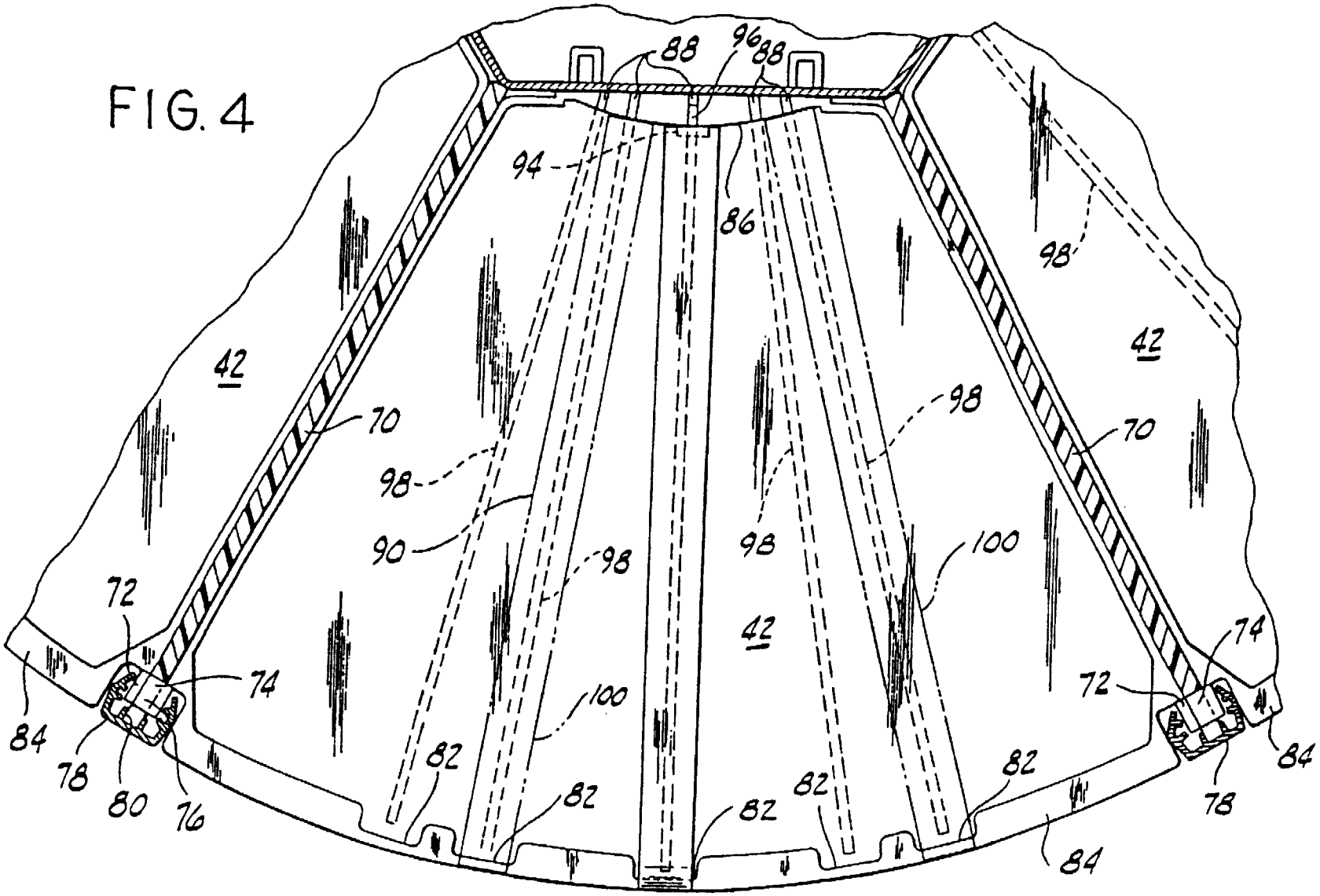
FIG. 4 is an enlarged partial sectional plan view of a portion of a shelf.

In order to rigidify the partitions 90 they are designed to engage the bottom of the tray above them. To achieve this in the preferred embodiment the bottom of each tray 42 is provided with a long tab 98 (FIG. 4) in alignment with the channels 82 and grooves 88 in each tray. A connecting piece 100 (FIG. 5) is provided which has a deep groove 102 along its lower edge for receiving the upper edge of a partition 90 and has a shallower groove 104 in its upper edge for receiving the long tab 98 in the lower surface of a tray. To assemble a partition between a top and bottom tray, the partition is first placed in the bottom tray with its outer edge 92 in a desired channel 82 and its tab 96 in a corresponding groove 88 so that the lower edge of the partition abuts the upper surface of the bottom tray. The connecting piece is then slid onto the top edge of the partition and simultaneously along the long tab 98 until it is abutting the center column 34. This locks the partition rigidly in place. This assembly procedure is repeated for as many of the partitions as is desired. The partitions 90 are preferably all made of transparent plastic to allow a customer to look through them and thus see more product than is in a single compartment 71.

The drum 30 is rotated by a reversible electric motor 106 (FIG. 3) whose operation is controlled by the main vending machine control circuit containing a microprocessor with appropriate programming to control various functions of the entire machine as described in U.S. Pat. No. 4,927,051 and to some extent as is set forth below. The motor 106 has a gear 108 secured to its output shaft which is drivingly engaged with the ring gear 48 secured to the bottom of the drum 30. Rotation of the motor 106 in either direction to allow a customer to review product in various areas of the drum 30 is controlled by two buttons 107 and 109 on the front of cabinet 16 (FIG. 1). This allows a customer to rotate the drum 30 either left or right by pushing the appropriate button 107 or 109. The microprocessor keeps track of the rotational position of the drum 30 through input from the motor 106 and a microswitch 111. Switch 111 is activated when a home position pin 113, secured to the bottom of ring gear 48, engages the arm of a bi-directional rotating thermal break actuator 115 mounted for rotation in the cabinet floor. The actuator 115 has a camming surface on its lower end which engages the microswitch 111 and activates it when the pin 113 engages the arm of the actuator and moves it as the drum rotates in either direction. The actuator is biased by a spring (not shown) to a home position where it will be engaged by the pin 113 each time it passes.

In order to accurately stop the turning of the drum 30 so that a selected compartment 71 is located directly in front of the appropriate access door 12, a spring loaded solenoid 110 is used. When the motor 106 is to be activated the solenoid 110 is first activated to remove its plunger 112 from one of a series of corresponding holes 114 formed in the underside of the ring gear 48. There is a hole 114 corresponding to each possible partition 90 and wall 70 location in the drum 30 so that each compartment 71 can be exactly registered with an appropriate access door 12. Registration of the compartment 71 is effected by aligning the left hand partition 70 or wall 90 of a compartment with left most edge of the frame defining the access door opening as viewed in FIGS. 1 and 2. Thus, for the preferred embodiment there will be thirty six holes 114. Further operation of this control system is discussed in detail in U.S. Pat. No. 4,927,051.

Figure 6:
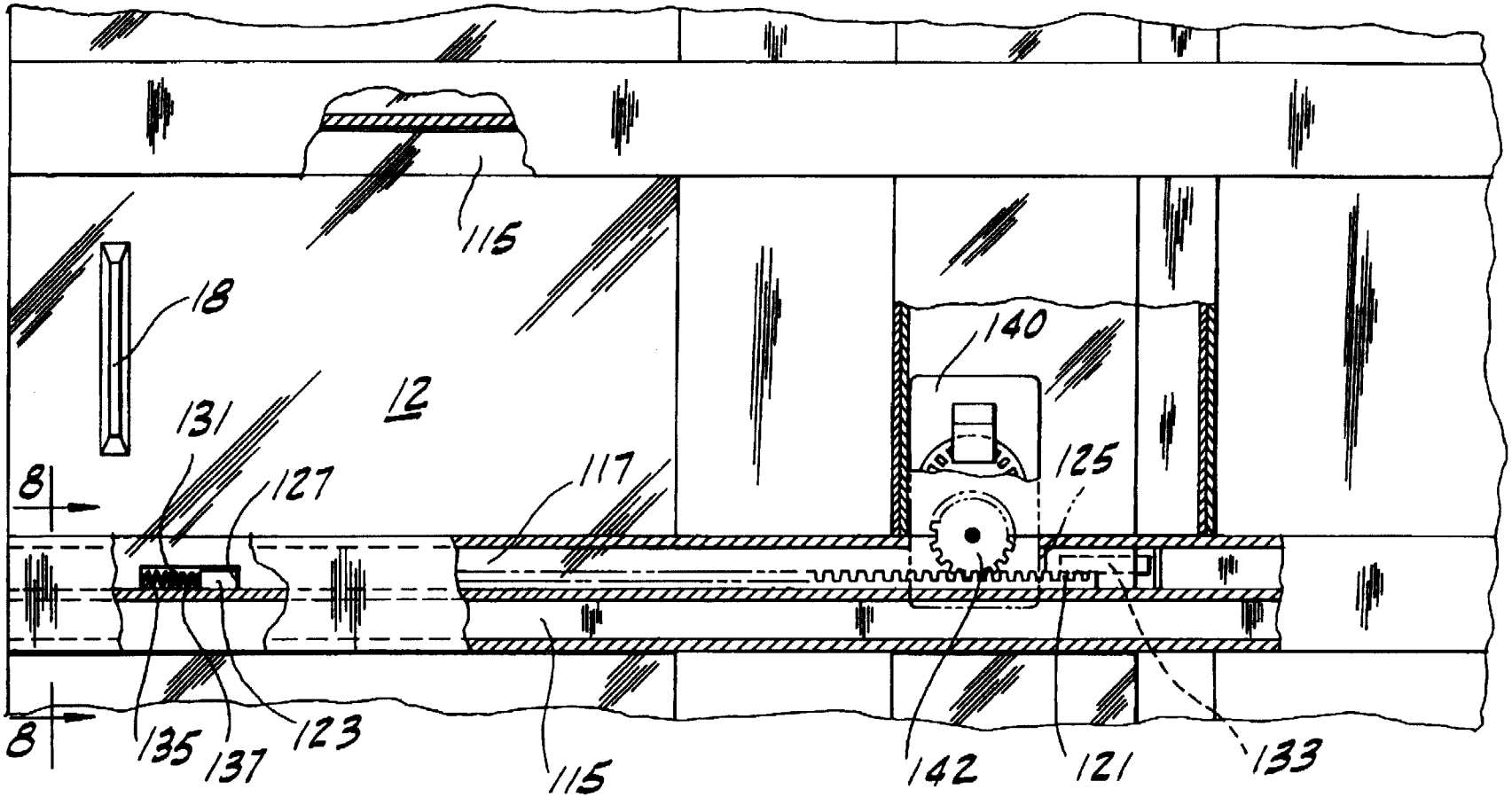
FIG. 6 is an enlarged partial sectional plan view of an access door area.
Figure 7:
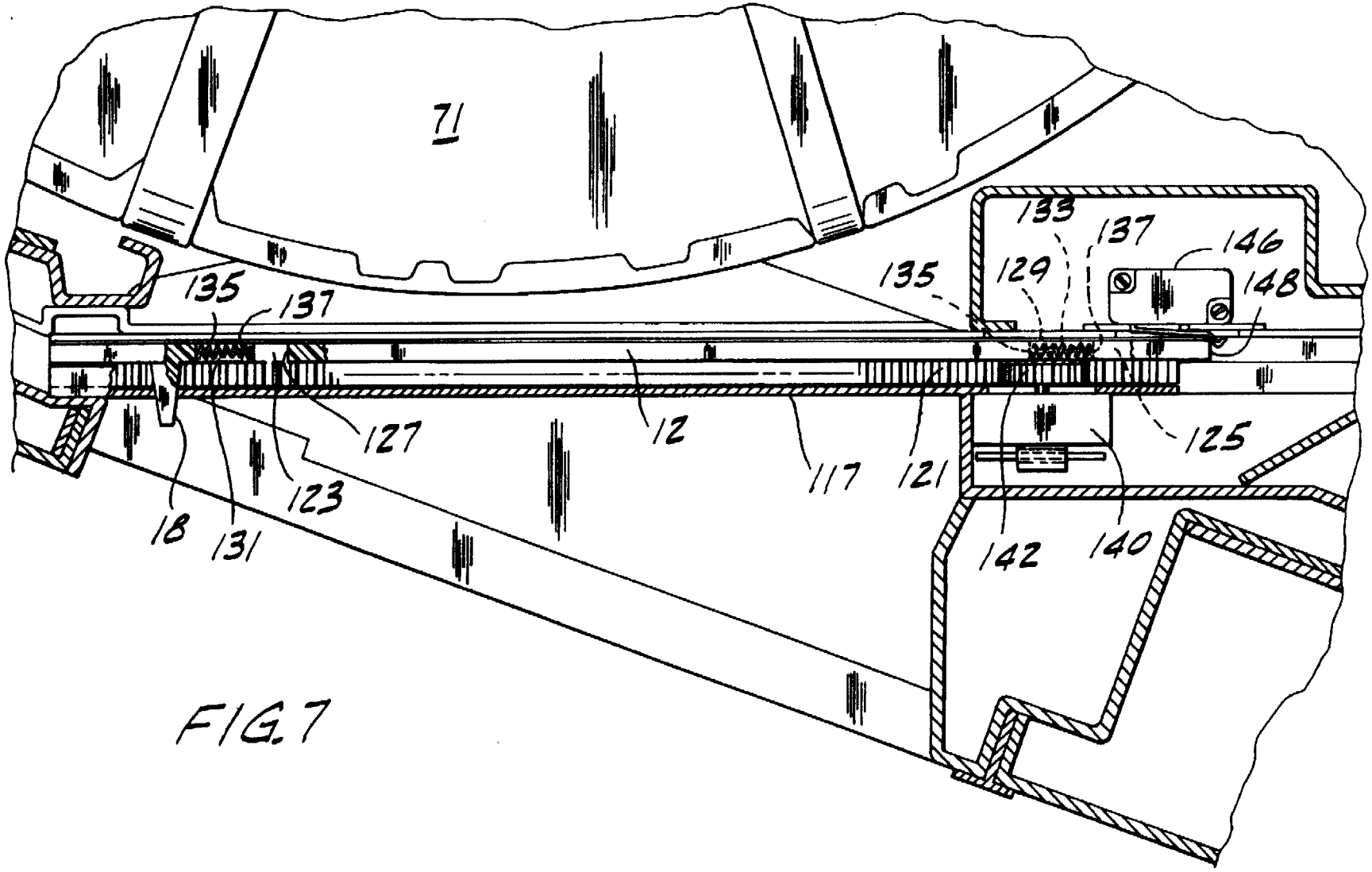
FIG. 7 is an enlarged partial sectional top view of the access door area of FIG. 6.
Figure 8:
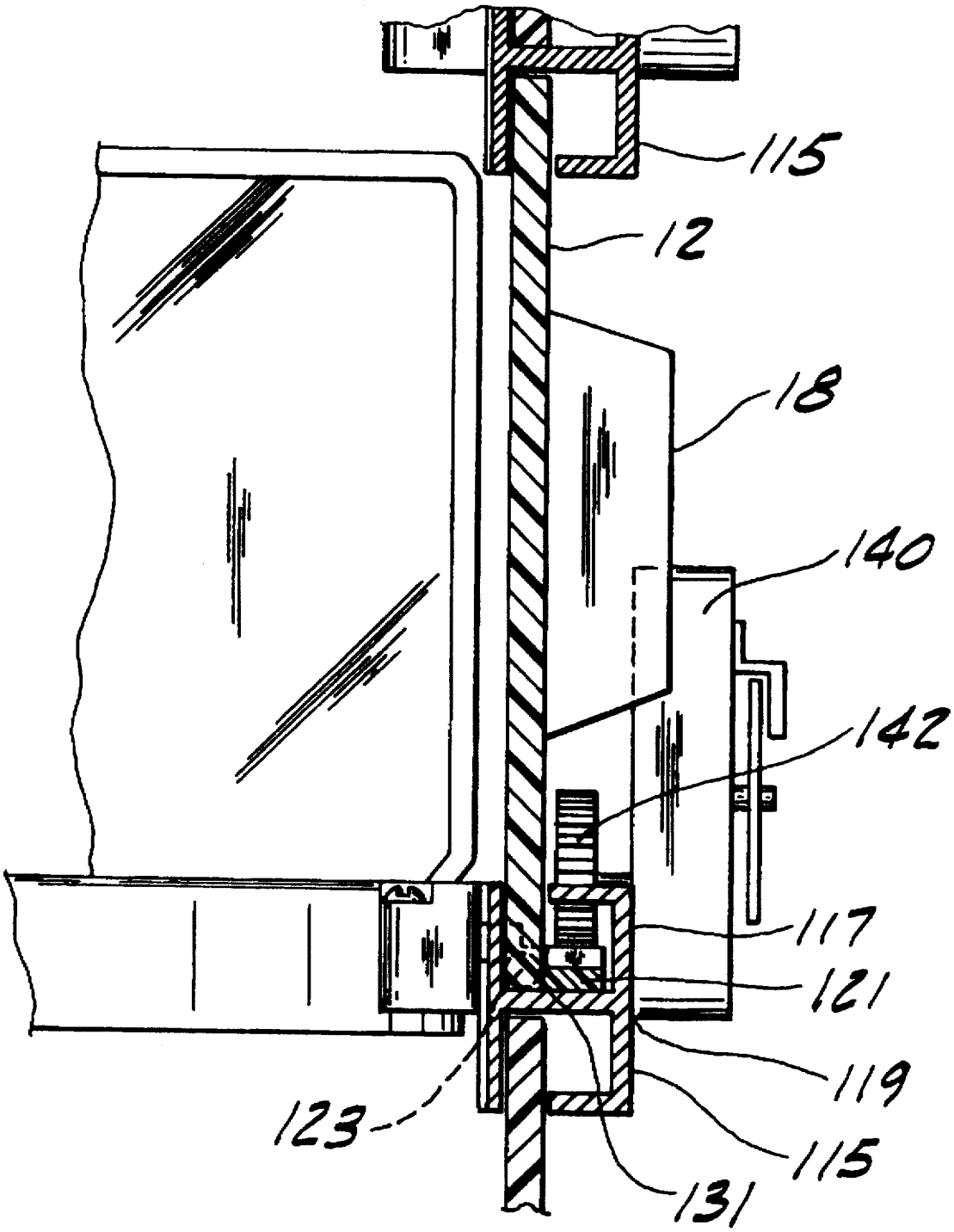
FIG. 8 is an enlarged sectional side view of the access door area of FIG. 6.

Referring again to the compartment access doors 12, as previously mentioned they are all in vertical alignment but are offset at an angle from the plane of the service door 14 and are generally tangent to the drum 30 for ease of access to compartments 71 which are aligned with them (FIG. 2). As seen in FIGS. 6–8, each access door 12 is mounted for sliding movement in a pair of parallel spaced upper and lower channels 115 and 117, respectively, which are secured to service door 14. In the preferred form a pair of channels 115 and 117 are formed of a single extruded piece 119 so that vertically adjacent doors 12 are supported by the channels formed in a single piece 119.

Mounted for sliding movement within each lower channel 116 is a rack gear 121 which extends for substantially the length of the associated door 12. Integrally formed with or secured to the inside edge of each rack gear 121 are a pair of rectangular door stop members 123 and 125. Corresponding rectangular slots 127 and 129 are formed in the bottom of each door 12 to slidingly receive the respective stop members 123 and 125. Helical-coil compression springs 131 and 133 are inserted and partially compressed within respective slots 127 and 129 between a front end wall 135 of the slots and a front surface 137 of each stop member 123 and 125. This structure permits the door 12 to be manually slid by handle 18 for a short distance to the right without the movement of rack gear 121, and when the handle 18 is released, assuming there has been no movement of the rack gear 121, the door 12 will be returned by springs 131 and 133 to the fully closed position.

A plurality of reversible access door drive motors 140, one being associated with each access door 12, are mounted to and within the structure of the service door 14. Each motor 140 is positioned so that its drive shaft supports a pinion gear 142 in driving engagement with a respective rack gear 121 for opening and closing an associated access door 12. The drive motors 140 are shown as sealed units which would contain appropriate gear reduction systems for rotating gears 121 to move the access doors 12 in either direction at the desired speed. The motor and/or gear reduction system are preferably so designed that attempted manual movement of the door beyond that permitted by springs 131 and 133 cannot override the mechanical advantage of the system and thus provides an effective lock against forcing an access door 12 open. Mounted to an output shaft of the gear reduction system, for rotation therewith is a timing disk 144 and associated photo sensors and light source (not shown) which act together in a well known manner to provide direction and radial position indication signals to the motor control circuits for allowing the control circuits to keep constant track of the position of the access doors 12 and the direction of their movement through movement of the associated motors 140. Other means than timing disk 144 and light source and photo sensors can be used to determine the position of the access doors and/or the motors 140 so long as the means is sufficiently accurate to position the door 12 aligned with the partition 90 or wall 70 forming the right edge of the compartment 71 aligned with the access door 12.

In order to sense the slight movement of an access door 12 caused by a customer manually attempting to move the door to the right by handle 18, a microswitch 146 is mounted inside the service door 14 adjacent the access door 12 and in engagement with the back edge 148 of the access door 12. Thus, as the access door is moved slightly to the right it activates microswitch 146 which sends a signal to the control circuit. The control circuit checks if more than one door 12 is attempted to be opened and if so will not allow any access door to be opened. Also, the control circuit checks if adequate credit has been established to purchase the item contained in the compartment 71 positioned behind the door 12 and, if so, activates the associated drive motor 140. The control circuit also determines at that time the size of the compartment 71 positioned behind the door 12 attempted to be opened. Drive Motor 140 then moves the rack and thus opens the door 12 the required amount to allow access to the compartment aligned with the door but preventing access to any other compartments associated with that door. So if the compartment is a narrow one the door will only open far enough that its front edge is aligned with the partition 90 or wall 70 forming the right side of the compartment 71 as seen in FIGS. 1 and 2. This movement is controlled by monitoring the rotation of the timing disk 144.

After the door 12 has been opened to its fully opened position for the compartment aligned with it for a predetermined amount of time, e.g. 10 seconds, sufficient to allow the customer to remove the product in the associated compartment 71, the motor 140 is again activated in the reverse direction to close the door 12. Movement of the door 12 in this direction is again monitored by monitoring rotation of timing disk 144 and stopping the motor at the door closed or home position for door 12. The springs 131 and 133 then keep the door front edge in engagement with the left wall of the opening to keep a tight seal between the door and the wall.

In case the customer has not had sufficient time to remove the purchased product from the compartment before the associated access door begins to close, provision is preferably made for sensing resistance to closing of the access door as may be encountered if the door engages the hand of the customer still extended into the compartment. This can be done in several ways, for example, sensing a rise in current of the motor or monitoring for a change in movement of the disk 144. Once a change is sensed by the control circuit it reverses the motor 140 and opens the door for another period of time and then again attempts to close the door and will do so unless further resistance is encountered.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A multiple-product merchandising machine comprising:

a cabinet defining an interior and having at least one product access opening defined therein;

at least one product access door associated with a respective product access opening in the cabinet, the door being movable between an open position to permit access to the interior of the cabinet through the associated product access opening, and a closed position in which access to the interior of the cabinet through the product access opening is prevented;

a plurality of product compartments each formed in part by adjacent walls having outer edges defining different widths for different compartments, the compartments being mounted in the cabinet for movement past the at least one access door and accessible through the respective product access opening when the door is in the open position;

currency actuated means for allowing a selected access door to be moved from the closed position to the open position when a predetermined amount of currency is inserted by a customer;

means for opening any one of the at least one access doors to an open position corresponding to the width of a compartment aligned with its associated product access opening; and means for correlating the location of each compartment relative to the product access opening and controlling the opening means to adjust the open position of the door to the width of the compartment aligned with the product access opening for each time a product is purchased.

2. A multiple-product merchandising machine as defined in claim 1 wherein the means for opening the door includes means for closing the door after it has been opened for a predetermined time.

3. A multiple-product merchandising machine as defined in claim 2 including means for sensing resistance to the closing movement of the door and causing the means for opening the door to reopen the door and thereafter again close the door.

4. A multiple-product merchandising machine as defined in claim 2 wherein the means for opening and closing the door includes:

a rack gear engaging the door to cause movement of the door between its open and closed positions;

a pinion gear mounted for rotation in driving engagement with the rack gear;

a reversible motor for rotating the pinion gear; and means interconnecting the door and the rack gear so as to allow limited movement of the door relative to the rack gear when the door is in its closed position.

5. A multiple product merchandising machine as defined in claim 1 wherein the compartments are formed of movable partitions so as to allow the adjustment of the widths of the compartments.

6. A multiple-product merchandising machine as defined in claim 1 including means for sensing slight opening movement of the door and including means for determining if sufficient credit has been established to allow a purchase from the machine and to allow the door to be opened once the means for sensing door movement senses opening of the door.

7. A multiple-product merchandising machine comprising:

a cabinet defining an interior and having a plurality of product access openings defined therein;

a plurality of product access doors each associated with a respective product access opening in the cabinet, each door being movable between an open position to permit access to the interior of the cabinet through the associated product access opening, and a closed position in which access to the interior of the cabinet through the product access opening is prevented;

a plurality of product compartments each formed in part by adjacent walls having outer edges defining different widths for different compartments, the compartments being disposed in a plurality of groups, each group of compartments being mounted in the cabinet for movement past an associated product access door and accessible through the respective opening when the door is in the open position;

currency actuated means for allowing a selected access door to be moved from the closed position to the open position when a predetermined amount of currency is inserted by a customer for a purchase of a product;

means for opening any one of access doors to an open position corresponding to the width of a compartment aligned with product access opening; and means for correlating the location of each compartment relative to its respective product access opening and controlling the opening means to adjust the open position of the door to the width of the compartment aligned with the product access opening for each time a product is purchased.

8. A multiple-product merchandising machine as defined in claim 7 wherein the means for opening any one of the doors includes means for closing the doors after they have been opened for a predetermined time.

9. A multiple-product merchandising machine as defined in claim 8 including means for sensing resistance to the closing movement of a door and causing the means for opening the door to reopen the door and thereafter again close the door.

10. A multiple-product merchandising machine as defined in claim 8 wherein the means for opening and closing the doors includes:

a rack gear engaging a respective door to cause movement of the door between its open and closed positions;

a pinion gear mounted for rotation in driving engagement with the rack gear;

a reversible motor for rotating the pinion gear; and means interconnecting the door and the rack gear so as to allow limited movement of the door relative to the rack gear when the door is in its closed position.

11. A multiple-product merchandising machine as defined in claim 7 including means for sensing an attempt to open any one of the doors.

12. A multiple-product merchandising machine as defined in claim 11 including means for determining if sufficient credit has been established to allow a purchase from the machine and to allow the door to be opened once the means for sensing door movement senses an attempt to open the door.

13. A multiple-product merchandising machine comprising:

a cabinet with a product access opening defined therein;

a plurality of product compartments each having an open side and mounted in the cabinet for movement of the open sides past the product access opening so as to provide access thereto for a purchased product and means for adjusting the dimension of the open side in the direction of movement thereof of at least some of the compartments so that compartments having different dimensions of the open sides will move past the product access opening;

a vend door associated with the product access opening and mounted to the cabinet for movement in the direction of movement of the compartments between a closed position wherein it is covering the product access opening and an open position wherein it allows access to a compartment aligned with its associated product access opening;

drive means for moving the vend door between its open and closed positions;

control means for causing the drive means to vary the open position of the door to match the dimension of the open side of a compartment aligned therewith for each time a product is purchased; and currency actuated means for allowing the access door to be moved from the closed position to the open position when a predetermined amount of currency is inserted by a customer.

14. A multiple-product merchandising machine as defined in claim 13 wherein the drive means for the door includes:

a rack gear engaging the door to cause movement of the door between its open and closed positions;

a pinion gear mounted for rotation in driving engagement with the rack gear;

a reversible motor for rotating the pinion gear; and means interconnecting the door and the rack gear so as to allow limited movement of the door relative to the rack gear when the door is in its closed position.

15. A multiple-product merchandising machine as defined in claim 13 including means for sensing slight opening movement of the door.

16. A multiple-product merchandising machine as defined in claim 15 including means for determining if sufficient credit has been established to allow a purchase from the machine and to allow the door to be opened once the means for sensing door movement senses opening of the door.

17. A multiple-product merchandising machine comprising:

a cabinet with a plurality of product access openings defined therein;

a plurality of product compartments disposed in a plurality of groups, each group being mounted in the cabinet for movement past an associated product access opening, each compartment having an open side and mounted in the cabinet for movement of the open sides past the associated product access opening so as to provide access thereto for a purchased product and means for adjusting the dimension of the open side in the direction of movement thereof of at least some of the compartments so that compartments having different dimensions of the open sides will move past the associated product access opening;

a vend door associated with each product access opening and mounted to the cabinet for movement in the direction of movement of the compartments associated therewith between a closed position wherein it is covering the product access opening and an open position wherein it allows access to a compartment aligned with its associated product access opening;

drive means for moving a selected vend door between its open and closed positions;

control means for causing the drive means to vary the open position of the selected door to match the dimension of the open side of a compartment aligned therewith for each time a product is purchased; and currency actuated means for allowing a selected access door to be moved from the closed position to the open position when a predetermined amount of currency is inserted by a customer.

18. A multiple-product merchandising machine as defined in claim 17 wherein the drive means for each door includes:

a rack gear engaging the door to cause movement of the door between its open and closed positions;

a pinion gear mounted for rotation in driving engagement with the rack gear;

a reversible motor for rotating the pinion gear; and means interconnecting the door and the rack gear so as to allow limited movement of the door relative to the rack gear when the door is in its closed position.

19. A multiple-product merchandising machine as defined in claim 17 including means for sensing slight opening movement of any of the doors.

20. A multiple-product merchandising machine as defined in claim 19 including means for determining if sufficient credit has been established to allow a purchase from the machine and to allow a selected door to be opened once the means for sensing door movement senses opening of the door.

* * * * *

UNITED STATES PATENT AND TRADEMARK OFFICE

CERTIFICATE OF CORRECTION

PATENT NO. : 5,730,316
DATED : March 24, 1998
INVENTOR(S) : Leonard P. Falk

It is certified that error appears in the above-identified patent and that said Letters Patent is hereby corrected as shown below:

Column 1, line 11, "access door into" should read ---access door once the customer has inserted adequate currency into---.

Column 8, claim 1, line 53, "customer;" should read ---customer for a purchase of a product;---.

Column 9, claim 7, line 55, "with product" should read ---with its associated product---.

Signed and Sealed this

Tenth Day of November 1998

*Attest:*

*Attesting Officer*

BRUCE LEHMAN

*Commissioner of Patents and Trademarks*